US005467924A

United States Patent [19]

Buescher et al.

[11] Patent Number: 5,467,924

[45] Date of Patent: Nov. 21, 1995

[54] UNIT INJECTOR OPTIMIZED FOR REDUCED EXHAUST EMISSIONS

[75] Inventors: Alfred J. Buescher, 17001 Shaker Blvd., Shaker Heights, Ohio 44120; Frank DeLuca, Enfield, Conn.

[73] Assignee: Alfred J. Buescher, Shaker Heights, Ohio

[21] Appl. No.: 309,030

[22] Filed: Sep. 20, 1994

[51] Int. Cl.[6] ..... F02M 47/00; F02M 65/00

[52] U.S. Cl. ..... 239/88; 239/533.3

[58] Field of Search ..... 239/88–92, 95, 239/96, 533.3–533.12

[56] References Cited

U.S. PATENT DOCUMENTS 3,006,556 10/1961 Shade et al. ..... 239/88

4,317,541 3/1982 Beardmore ..... 239/88

4,801,095 1/1989 Banzhaf et al. ..... 239/533.3

5,333,786 8/1994 Gant et al. ..... 239/90

*Primary Examiner*—Karen B. Merritt

*Attorney, Agent, or Firm*—Pearne, Gordon, McCoy & Granger

[57] ABSTRACT

A diesel unit injector of the EMD type is provided with a tip whose radius is centered below the center of radius of the sac which it encloses, and the sac volume is minimized. The lower face of the nozzle body of the injector is faired in such a manner as to maintain a strong wall cross-section. A system utilizing a set of potential substitute spring seats is used to reset the opening pressure, as upon rebuilding, within narrow tolerances. The nozzle body is shortened and the check valve cage correspondingly lengthened to reduce the length of the injector valve proper. Trapped volume is reduced consistently with fuel flow requirements.

10 Claims, 1 Drawing Sheet

UNIT INJECTOR OPTIMIZED FOR REDUCED EXHAUST EMISSIONS

FIELD OF THE INVENTION

This invention relates generally to fuel injection nozzles used in diesel engines, and particularly to locomotive engine fuel injectors which are unit injectors of the type known as EMD injectors, originally manufactured by Diesel Equipment Division of General Motors for Electro Motive Division of General Motors.

BACKGROUND OF THE INVENTION

EMD-type unit injectors are characterized by a nozzle valve body which terminates in a nozzle tip and houses a nozzle valve. The seat for the nozzle valve is formed at or near the nozzle tip and communicates with a small spray hole feed chamber, or "sac," just below the seat and within the tip. The sac has a cylindrical sidewall and a hemispherical bottom wall. The fuel is distributed through the sac under high pressure to spray holes which are several times longer than their diameter. The spray holes lead from the sac through the wall of the injector tip and into the engine chamber where the fuel is atomized.

Valves of the EMD type are further characterized by a spring seat which couples the spring to the nozzle valve. The spring holds the valve in seated, closed position until overcome by pressure of incoming fuel acting on a conical differential area of the nozzle valve. This action forces the valve in the opening direction against the bias of the spring. The spring seat and spring are carried in a spring cage stacked just above (upstream of) the nozzle valve body.

EMD-type valves are further characterized by provision of a disc type check valve carried in a check valve cage which is stacked just above or upstream of the spring cage.

The spring cage, check valve cage, and nozzle valve body are stacked coaxially one above the other within the injector housing-nut. The stack length of the nozzle valve body slightly exceeds the combined stack lengths of the check valve cage and the spring cage. The injector housing-nut houses the stacked components that are at the injection end of the injector. The housing-nut is fixed in the head of the engine and extends through it. On the exterior side, the housing-nut is threaded to and acts as an extension of the main housing of the pump-injection unit.

In today's diesel engine operating environment, the general public is reminded daily about the health effects of exhaust emissions. As a result, the government is relentlessly reducing the levels of permissible smoke and hydrocarbons emitted from the engine exhaust. There is a great need for improvements to meet the requirements of ever-increasing government restrictions, particularly for improvements in EMD-type locomotive fuel injectors, a type already widely used and whose use can be widely supported by existing networks of rebuilders as well as original equipment manufacturers.

It is universally recognized today in the fuel injection and diesel engine industries that reducing the sac volume of closed-type inwardly-opening nozzles reduces engine exhaust smoke and hydrocarbon emissions, all other factors being equal. However, reducing the sac volume of a EMD-type injection nozzle is not a simple matter. Maintaining the integrity of the nozzle durability characteristics is the primary consideration of a product, as performance improvement at the expense of reliability is totally unacceptable. In addition, reducing the sac volume must not compromise the optimum relationship of the nozzle spray hole length with respect to the hole diameter. The present invention enables these durability and spray hole requirements to be maintained while still reducing the sac volume to thereby achieve improvements in exhaust emissions.

The rate at which the nozzle valve closes is also known to have an influence on the quality of the fuel spray issuing from the nozzle at the very end of injection. If the nozzle valve closes slowly, the fuel that leaves the sac during the closing phase is replaced by fuel continuing to flow past the nozzle valve seat into the sac. If the nozzle valve closes rapidly, less fuel will flow into the sac, but in addition, the rapid valve displacement into the valve seat desirably gives added force to dispel the fuel from the sac through the orifices into the engine combustion chamber thus leaving little or no fuel in the sac to be drawn out in the late stages of the engine expansion stroke. Fuel drawn out of the sac during the late stages of expansion contributes greatly to hydrocarbon emissions and carboning of the nozzle tip.

There are several means by which increase of the nozzle valve closing rate can be accomplished. One would be to increase the nozzle opening pressure above the present specification level. However, this would tend to cause irregular injection in the low-speed part load range and idle. It would also increase the nozzle spring stress causing increased fall-off in opening pressure over time or, in some cases, resulting in spring failure. Changing the valve/seat diameter ratio would have similar effects.

Another means would be to make the nozzle valve opening pressure the same for all injectors. The specification for nozzle opening pressure of reconditioned injectors is 2800 to 3400 psi. During engine operation, the nozzle spring "sets," edges wear, and the spring length shortens a little so that the nozzle opening pressure decreases. Therefore, when rebuilding injectors reusing old springs, the opening pressure would tend to be toward the minimum specification level for most injectors. When using new springs also, there are slight differences in free length, wire diameter and effective coils; add to these, variation in spring cage length, all within the respective part specification tolerances, of course, and we have nozzle opening pressure variation between injectors being quite broad. All involved part specification tolerances are taken into consideration when the nozzle opening pressure specification is established, and this is the reason the nozzle opening pressure specification is so broad. Therefore, to obtain the maximum level of performance from an injector, it is preferable to set the opening pressure at the maximum level of the specification. This cannot be done with present EMD-type injectors. The present invention makes it possible to achieve this objective.

Still other improvements to improve engine exhaust smoke and hydrocarbon emission performance of EMD-type locomotive fuel injectors may be provided by the invention. These will appear in the following description, from which the improvements discussed above also will be more fully understood.

DETAILED DESCRIPTION OF THE INVENTION

Figure 1:
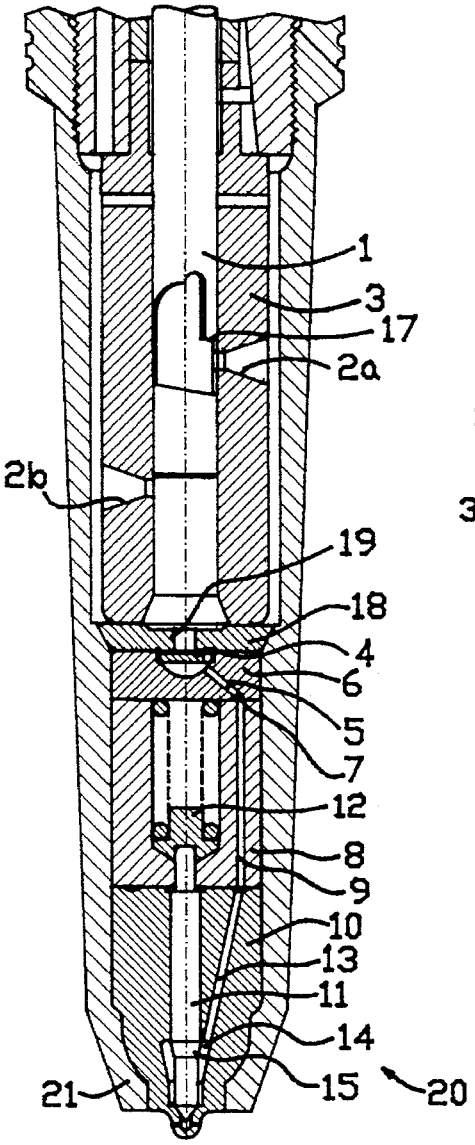
Fig.1 (PRIOR ART)
FIG. 1 is fragmentary cross-sectional view of a typical EMD-type injector of the prior art, with the top portions broken away and not shown.

In order that the invention may be most clearly understood, a conventional diesel locomotive fuel injection nozzle of the EMD type will first be described in some detail. Such a nozzle is shown in cross-section in FIG. 1, and is generally indicated by the reference numeral 20. This nozzle will be understood by those skilled in the art to be based on the nozzle shown in Shade et al. U.S. Pat. No. 3,006,556 the disclosure of which is incorporated herein by reference as if fully repeated herein.

The housing-nut 21 of the prior-art nozzle 20 is threaded to and is an extension of the main housing (not shown) for the pump-injection unit. The nut 21 extends from the main housing, which is at the exterior of the engine, through the engine wall to the combustion chamber, and is clamped in the engine wall in a well known manner. The housing-nut houses the stacked main injector components described below and threadedly clamps them in their stacked relationship in a well known manner.

EMD-type nozzles have a valve with differentially sized guide and seat so that there is a fixed relationship between the valve opening pressure and the valve closing pressure. During injector operation when the plunger 1 covers the fill port 2*a* in the bushing 3, see FIG. 1, a pressure wave is generated which travels past the check valve 4 and through the fuel ducts 5 in the check valve cage 6, through the annulus 7, fuel ducts 9 in the spring cage 8, into the illustrated connecting top annulus and the fuel ducts 13 of the nozzle body 10, and into the cavity 14 where the pressure wave acts on the conical differential area 15 of the nozzle valve 11 to lift the needle of the nozzle valve off its seat 16 and injection begins.

The valve stays lifted during the time fuel is being delivered by the plunger 1 to the nozzle 10. When the plunger helix edge 17 uncovers the spill port 2*b* in the bushing 3, the pressure above the plunger drops to fuel supply pressure and the check valve 4 in the valve cage 6 seats on the plate 18, sealing the fuel transport duct 19. As these events occur, the pressure in the nozzle fuel chamber 14 then drops rapidly; when it drops to the valve closing pressure, the valve closes and injection ends.

In a well known manner, the angular position of the plunger is changed by a control rack (not shown) to control the amount of fuel delivered with each stroke of the plunger 1 by varying the positions in the stroke at which the fill and spill ports 2*a* and 2*b* are opened and closed.

Figure 2:
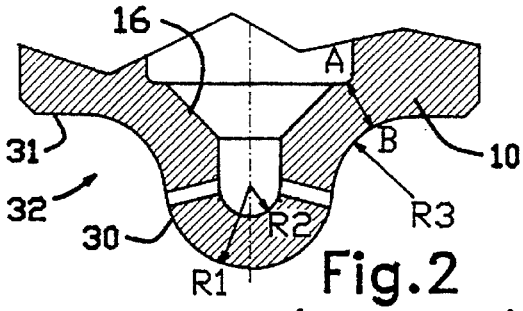
Fig.2 (PRIOR ART)
FIG. 2 is an enlargement of the lower end of the nozzle body seen in FIG. 1.

As seen in FIG. 1, the housing-nut 21 has an open lower end through which the end face of the nozzle body 10 is exposed. FIG. 2 shows the end face on an enlarged scale and in clearer detail. The end face comprises an inverted central dome 30 forming the nozzle tip, an edge zone 31 substantially normal to the central axis of the injector, and a fairing zone 32 between the dome or tip 30 and the edge zone 31. The fairing zone 32 is shaped to fair the dome or tip 30 into the edge zone 31.

Universal present practice in the design of sac-type nozzles for open chamber diesel engines is to design the tip with the tip and sac radii having the same center, as is the case for the tip radius R1 and sac radius R2 seen in FIG. 2. The wall thickness of the tip will be seen to be uniform and minimal around almost 180 degrees of the tip cross-section, gradually thickening as the fairing zone 32 is approached where the tip face is faired into the flat rim portion of the nozzle body end face. Additionally, in accordance with prior-art practice to provide adequate nozzle tip strength, in FIG. 2 the fairing zone 32 is seen to comprise a surface of reverse radius R3, comparable in magnitude to the tip radius R1, such that there is a thick minimum cross-section A-B between the lower part of the cavity 14 and the tip exterior.

Only two spray holes are shown in the drawing; in practice typically 6–10 spray holes are evenly distributed around the periphery of the sac.

Figure 2A:
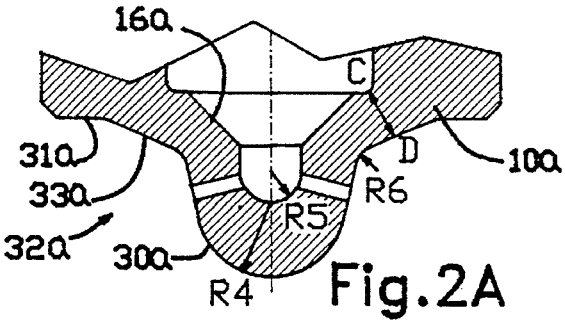
FIG. 2A is an enlargement of the lower end of the nozzle body seen in FIG. 1A.

According to the present invention, sac volume is greatly reduced while retaining the same spray hole length and retaining the strength in the nozzle tip, by modifying the nozzle tip as shown in FIG. 2A. Again, only two spray holes are shown, but it will be understood that additional holes are distributed around the periphery of the sac. In this illustrated construction, the sac radius, R5, is unchanged in magnitude from that of the radius R2 of FIG. 2, and the diameter of the sac therefore remains the same. However, the center of the tip radius is below that of the sac radius, and is preferably closer to the bottom of the sac than it is to the center of the sac radius. Even more preferably the center of the tip radius is located at the bottom of the sac as shown in FIG. 2A. Preferably, as also seen in FIG. 2A, the length to diameter ratio of the sac is less than 1. The wall thickness of the tip actually increases toward the lower tip extremity; however the length and configuration of the holes remain optimal for proper fuel atomization.

In addition, cross-sections governing tip strength are retained by providing a fairing zone 32*a* which comprises (1) a surface whose reverse radius R6 is less than the minimal wall thickness of the tip and therefore substantially smaller than the associated tip radius R4 and, particularly, much smaller than corresponding radius R3 of the prior-art nozzle shown in FIG. 2, and (2) a frustoconical surface 33*a* tapering down to the edge zone 31*a*, the latter being normal to the axis of the injector, or substantially so. These changes allow the thickness of the section C-D to be equal to that of the section A-B of the EMD-type prior-art nozzle shown in FIG. 2 to thereby retain the structural integrity and durability of the nozzle body below the valve seat.

These foregoing improvements allow a 50% reduction in sac volume while retaining the reliability characteristics of prior-art EMD-type nozzles.

Preferably, as shown, all the interior and exterior surfaces of the nozzle tip seen in FIG. 2A comprise regular spherical, conical, cylindrical or toroidal surfaces of revolution which, although compoundly curved, can be generated with reference to fixed centers, so that machining of such surfaces can be accomplished, and the tooling for such machining can be provided, in a straightforward and economic manner.

In another aspect of the invention, the closing rate of EMD-type nozzles is increased by a novel opening-pressure-setting procedure to achieve, within narrow tolerances, maximum specified opening pressure, thereby realizing performance gains related to high opening pressure while avoiding the disadvantages and problems attendant on increasing the nozzle opening pressure above specification level or changing the valve/seat diameter ratio.

According to this aspect of the invention, a rebuilt nozzle assembly, including the spring (new or old), is subjected to an initial pressure test which measures the pressure at which the nozzle opens. This pressure test may be conducted in a suitable pressure test fixture (not shown) which cages a subassembly comprising at least the assembled spring cage, spring, spring seat, nozzle valve and nozzle body, and which couples the fuel ducts 5*a*, 9*a*, 13*a* of the subassembly to a pressure source (not shown) in such a manner that fuel at monitored pressures is fed from the source to the subassembly. Pressure is increased until the pressure is reached at which the nozzle opens. The pressure is monitored by a suitable gage (not shown) and the measure or magnitude of the opening pressure is observed and noted, either visually and manually or by automated instrumentation (not shown).

This measured opening pressure becomes the reference set point for nozzle opening pressure. Until the nozzle opens during the initial pressure test, the compression displacement of the spring (the distance by which it is foreshortened from its fully relaxed condition) is some definite (but not necessarily measured) distance determined by the dimensions of the spring and the parts confining the spring.

A system is provided for incrementally adjusting the compression displacement of the spring to correspondingly incrementally adjust nozzle opening pressure, and for selecting the number of increments of adjustment. Each increment of adjustment changes nozzle opening pressure from one set point to the next, the reference pressure being the initial set point, and the degree of change of set pressure for each increment of adjustment being determined by the spring rate. The increments of adjustment are discrete and discontinuous (they correspond to exchangeable parts, i.e. exchangeable spring seats, whose differences in length correspond to the increments) rather than infinitesimal and continuous (e.g., length adjustment via threaded members), so that the set points do not constitute a linear continuum but differ by intervals corresponding to the magnitude of the increments of adjustment.

The system comprises a set of a suitable number (say four or five) of spring seats of progressively greater lengths, the differences in their lengths corresponding to the increments of adjustment. The spring seats are preferably marked with their lengths or marked with codings corresponding to their lengths. Since each spring seat in the set differs from the original spring seat only in length, if at all, each seat can be manufactured at no greater cost than a seat of the original dimensions, and each seat will be substantially as strong, simple and reliable as a seat of the original dimensions.

Figure 3:
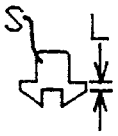
FIG. 3 is a diagrammatic view representing a set of spring seats of varying length L which is used according to the invention.

The set of spring seats of varying length is not shown in the drawings but is represented conceptually by the spring seats set S shown in FIG. 3 whose length L is varied incrementally by selection from the set, as to be described.

Following the initial pressure test, adjustment of the compression displacement of the spring through a number of increments of compression displacement is effected. This number of increments is selected such that nozzle opening pressure is adjusted to the set point that is closest to the maximum specified opening pressure without exceeding it. This selection is accomplished by replacing the spring seat used during the test with the spring seat from the set whose difference in length from the test spring seat corresponds to the selected number of increments. If say five spring seats are provided in the set, adjustment through from one to four increments would be possible by replacement of the spring seat. The choice of the proper replacement spring seat is preferably determined by a suitable guide chart or the like showing the replacement seat to be chosen for any reference pressure produced by the original pressure test, or the guide information may be learned and the choice made by applying such information from memory, or less preferably the choosing can be done by trial and error by conducting a pressure test after each exchange of valve seats. If desired, a confirmatory final pressure test may be performed in any case.

These procedures will be understood to constitute a method of adjusting the opening pressure comprising the steps of assembling the subassembly of the spring, spring cage, spring seat, nozzle valve and nozzle body, coupling the fuel ducts of the subassembly to a pressure source in such a manner that pressurized fuel is fed from the source to the subassembly, feeding fuel to the subassembly under increasing pressure until the nozzle valve opens to thereby define a reference set point for nozzle opening pressure, and selecting that number of point-to-point increments of adjustment from said reference set point to a final set point that is such that said final set point is the highest one of the available set points that does not exceed the maximum specified opening pressure. The selection step is accomplished by choosing the appropriate spring seat from the set of spring seats that differ from each other in length in the same proportions that said set points differ from each other in pressure level.

It will be understood, for example, that if this method is designed to provide, say, five available set points, then five lengths of spring seat will be provided in the spring seat set, and from zero to four point-to-point increments of adjustment may be selected depending on the value of the reference set point established by the initial pressure test. If the selected number of increments of adjustment is zero, then the spring seat chosen is of the same length as the seat used in the initial pressure test, and may be the identical seat.

Another means to increase the closing velocity of the nozzle valve is to reduce the length of the valve. The EMD nozzle has a length-to-diameter guide ratio of 4.4, which is larger than necessary for its sealing and guide functions. By reducing the ratio to 3.125, the valve can be reduced by 7 mm resulting in a valve mass reduction of (29%). However, this reduction is desirably done in a way that allows the stack length of the assembly, and the dimensions of the nozzle valve spring and spring cage, to remain substantially unchanged while reducing both manufacturing and rebuilding costs.

Figure 1A:
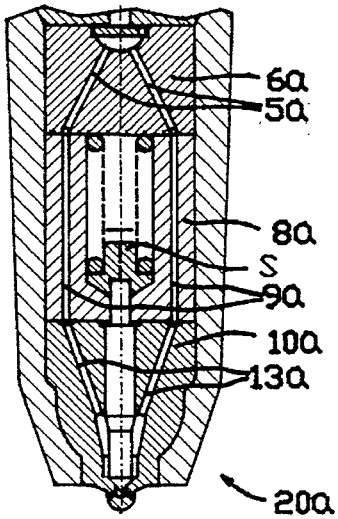
FIG. 1A is a fragmentary cross-sectional view of the lower end of an injector embodying the invention.
Figure 4:
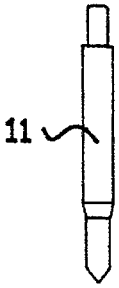
Fig.4 (PRIOR ART)
FIG. 4 is a view of the nozzle valve of the prior-art injector of FIG. 1.
Figure 4A:
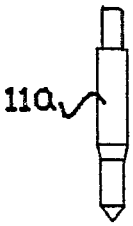
FIG. 4A is a view of the nozzle valve of the injector of the present invention shown in FIG. 1A.

The improved injection nozzle assembly 20*a* of the invention is shown in FIGS. 1A and 4A. The lengths of the valve 11*a* and nozzle body 10*a* are reduced from those of the valve 11 and body 10 by a given amount, 7 mm in the illustrated case, to reduce the length-to-diameter ratio of the bearing portion of the valve stem (the major diameter portion of the valve 11*a*) to 3.125. The length of the check valve cage 6*a* is increased from that of the check valve cage 6 by the same amount to retain the original overall stack length. The length of the spring cage 8*a* remains the same as that of the cage 8. It will be noted that the axial length of the nozzle body 10*a* including the tip is substantially no greater than the length of the spring cage 8*a*, and the length of the bearing portion of the stem of the valve 11*a* (see FIG. 4A) is substantially less than the length of the valve spring.

The increase in cost associated with manufacture of the relatively long check valve cage 6*a* is outweighed by the decrease in cost associated with manufacture of the relatively short valve 11*a* and nozzle body 10*a*. Because nozzle bodies are typically the only one of the three kinds of parts (nozzle bodies, injection valves, and check valve cages) that are replaced when rebuilding the injectors to new injector specifications, the cost of rebuilding is reduced also.

It is known that the smaller the trapped volume in an injection system, the higher the injection pressure will be at any specific fuel injection quantity level and speed. On the other hand, flow passages must be of sufficient diameter to avoid significant flow resistance and any high costs associated with the formation of passages of the smallest diameters. In general, in prior-art EMD-type injectors, as typified in FIG. 1, the check valve cage 6, spring cage 8 and nozzle body 10 each has three fuel ducts 5, 9 or 13, only one of each of which is seen in the FIG. 1 because it is a cross-sectional view and the ducts are equally angularly spaced 120 degrees from each other around the assembly.

An aspect of the present invention is the recognition that the fuel duct diameters and configurations of EMD type injectors are such that trapped volume can be reduced within the parameters mentioned above simply by reducing the number of fuel ducts from three to two. Thus in the injector of FIG. 1A, the valve cage 6*a*, spring cage 8*a* and nozzle body 10*a* each have only two fuel ducts 5*a*, 9*a* or 13*a*, both of which are seen in FIG. 1A because they are equally angularly spaced 180 degrees from each other around the assembly. This reduces total passage flow area of the fuel ducts to an amount that is still 4.5 times as large as the combined area of the orifices of the largest nozzle used in these injectors, without reduction in passage diameter. This ratio of flow area of ducts and nozzle orifices has been found to produce optimum results in high performance injection systems. In addition to the higher level of injection pressure produced with the reduction from three to two fuel ducts, the pressure wave produced at port closing is increased also which increases still further the partial load and idle regularity performance characteristics of the injector.

The foregoing improvements and combinations of improvements substantially improve engine exhaust smoke and hydrocarbon emission performance of EMD-type locomotive fuel injectors. It should be evident that this disclosure is by way of example, and that various changes may be made by adding, modifying or eliminating details without departing from the fair scope of the teaching contained in this disclosure. The invention therefore is not limited to particular details of this disclosure except to the extent that the following claims are necessarily so limited.

What is claimed is:

1. In a diesel unit injector of the EMD type having a plunger and bushing assembly to meter and deliver fuel, a check valve cage and check valve for preventing reverse flow of the fuel, a spring cage and a spring and spring seat within the cage, an injection nozzle body, a high pressure seal nozzle valve slidable in said nozzle body under the bias of said spring, axially extending fuel ducts in said check valve cage, spring cage and nozzle body, a housing-nut surrounding said plunger and bushing assembly, check valve cage and check valve, spring cage, spring and spring seat, injection nozzle body, high pressure seal nozzle valve, and axially extending fuel ducts, and threadedly clamping said bushing assembly, check valve cage and nozzle body in stacked relationship, said housing-nut having an open lower end, said nozzle body having an end face exposed through said open lower end of said housing-nut, said end face comprising an inverted central dome of a given radius forming a nozzle tip, an edge zone substantially normal to the central axis of the injector, and a fairing zone between said dome and said edge zone, said faring zone being shaped to fair said dome into said edge zone, a fuel sac formed in said tip and having a hemispherical sac bottom of a radius smaller than said dome radius, the centers of said dome radius and said sac bottom radius each lying on the central longitudinal axis of said injector, said nozzle body having a valve seat against which said valve seats under the bias of said spring and through which fuel flows into said sac under control by said valve, said sac communicating with nozzle spray holes through which fuel flows into the engine combustion chamber, the points of communication between said sac and said nozzle spray holes being spaced below said valve seat, the improvement wherein said center of said dome radius of the nozzle body is located below said center of said sac bottom radius.

2. A device as in claim 1, said center of said dome radius being located closer to the bottom of said sac than to said center of said sac bottom radius.

3. A device as in claim 2, said faring zone comprising a reverse radius surface of substantially smaller magnitude than said dome radius surrounded by a frustoconical surface tapering down to said edge zone.

4. A device as in claim 1, said center of said dome radius being located at the bottom of said sac.

5. A device as in claim 4, said faring zone comprising a reverse radius surface of substantially smaller magnitude than said dome radius surrounded by a frustoconical surface tapering down to said edge zone.

6. A device as in claim 1, said faring zone comprising a reverse radius surface of substantially smaller magnitude than said dome radius surrounded by a frustoconical surface tapering down to said edge zone.

7. A device as in claim 1, said high pressure seal nozzle valve having a valve stem, said valve stem having a bearing portion, the axial length of said nozzle body being substantially no greater than the axial length of said spring cage, and the length of said bearing portion of said valve stem being substantially less than the length of the valve spring as confined within said spring cage, whereby the mass of said valve is reduced and its closing velocity is correspondingly increased.

8. A device as in claim 7, the length-to-diameter ratio of said bearing portion of said valve stem being about 3.125.

9. A device as in claim 1, said nozzle spray holes together defining a given nozzle orifice area, said axially extending fuel ducts comprising a pair of ducts angularly spaced 180 degrees from each other in each of the stacked elements comprising said check valve cage, spring cage and nozzle body, whereby, for ducts of a given diameter, trapped volume of said injector is reduced as compared to the volume that would be associated with trios of ducts in said stacked elements so that the combined flow area through the two ducts is optimized relative to that required by said nozzle orifice area so that injection pressure at given flow rates is enhanced for improved low-load and low-speed engine operation.

10. A method of setting the opening pressure of the nozzle valve of a diesel fuel injector, as upon rebuilding or maintenance, to a value near but not exceeding maximum specified opening pressure comprising the steps of assembling a subassembly having fuel ducts and comprising at least the assembled spring, spring cage, spring seat, nozzle valve and nozzle body of the injector, coupling the fuel ducts of the subassembly to a pressure source in such a manner that pressurized fuel at monitored pressures is fed from the source to the subassembly, feeding fuel to the subassembly under increasing pressure until the nozzle valve opens to thereby define a reference set point for nozzle opening pressure, and selecting that number of pre-established point-to-point increments of adjustment from said reference set point to a final set point that is such that said final set point is the highest one of the available set points that does not exceed said maximum specified opening pressure, said selection step being accomplished by choosing the appropriate spring seat from a set of spring seats that differ from each other in axial length in the same proportions that said set points differ from each other in pressure level.

* * * * *